US006609482B2

(12) United States Patent
Ruohola et al.

(10) Patent No.: US 6,609,482 B2
(45) Date of Patent: Aug. 26, 2003

(54) METHOD IN A SODA RECOVERY BOILER, AND A SODA RECOVERY BOILER

(75) Inventors: Tuomo Ruohola, Tampere (FI); Antti Raukola, Kangasala (FI); Aki Hakulinen, Tampere (FI)

(73) Assignee: Kvaerner Power Oy, Tampere (FI)

( * ) Notice: Subject to any disclaimer, the term of this patent is extended or adjusted under 35 U.S.C. 154(b) by 0 days.

(21) Appl. No.: 10/136,423

(22) Filed: May 2, 2002

(65) Prior Publication Data

US 2002/0189553 A1 Dec. 19, 2002

(30) Foreign Application Priority Data

May 8, 2001 (FI) ..... 20010964

(51) Int. Cl.[7] ..... F22G 5/04
(52) U.S. Cl. ..... 122/7 R; 122/479.2; 165/104.16
(58) Field of Search ..... 122/1 B, 4 D, 122/7 R, 406.4, 479.2, 487; 165/104.16

(56) References Cited

U.S. PATENT DOCUMENTS

| | | | | |
|---|---|---|---|---|
| 4,294,200 A | * | 10/1981 | Gorzegno | 122/406.4 |
| 5,133,943 A | * | 7/1992 | Abdulally | 422/145 |
| 5,787,844 A | * | 8/1998 | Paju | 122/7 C |
| 5,911,956 A | * | 6/1999 | Viel Lamare et al. | 422/177 |
| 6,178,924 B1 | * | 1/2001 | Hakulinen et al. | 122/7 R |

* cited by examiner

*Primary Examiner*—Gregory Wilson
(74) *Attorney, Agent, or Firm*—Swidler Berlin Shereff Friedman, LLP

(57) ABSTRACT

In a soda recovery boiler, flue gases are led through a so-called economizer (3) to recover heat from flue gases. The flue gases are cooled in the last stage (3*b*) of the economizer (3) with a circulation water cooler (4) for flue gases, separate from the supply water system of the boiler. The circulation water cooler (4) for flue gases is used for preheating combustion air.

13 Claims, 6 Drawing Sheets

METHOD IN A SODA RECOVERY BOILER, AND A SODA RECOVERY BOILER

FIELD OF THE INVENTION

The invention relates to a method in a soda recovery boiler in which flue gases are led through a so-called economizer to recover heat from flue gases. The invention also relates to a soda recovery boiler comprising a furnace and an economizer which is arranged in the flow of flue gases to recover heat from flue gases exiting the furnace.

BACKGROUND OF THE INVENTION

In chemical pulping industry, soda recovery boilers are used not only for the recovery of chemicals but also for the production of energy. As to the general operating principle and structure of soda recovery boilers, reference is made, for example, to European patent 737260 and U.S. Pat. No. 6,178,924.

The soda recovery boiler comprises a furnace, a system for feeding boiler supply water, a superheater at the upper part of the furnace, possibly a boiler bank (array of boiler tubes), and, after these in the flowing direction of flue gases, a so-called economizer for the recovery of thermal energy contained by in the flue gases. The soda recovery boiler also comprises a combustion air supply for introducing the required combustion air in the furnace. Leading the supply water through different parts of the boiler produces high-pressure steam which is at a high temperature and can be used for the production of electricity with a steam turbine.

The aim is to utilize the heat contained in the flue gases in the economizer, in which it is used for heating the supply water before it is passed to steam production, as described for example in U.S. Pat. No. 5,769,156.

In soda recovery boilers, it is also known to cool the flue gases with a so-called circulation water cooler for flue gases, if the supply water is too hot for bringing the flue gases to a sufficiently low temperature, the circulation water cooler for flue gases being connected to the supply water flow circuit in the soda recovery boiler. The supply water is normally heated in a supply water tank by means of bleed steam extracted from a steam turbine. In soda recovery boilers, the temperature of the supply water tank must often be reduced by throttling the steam entering it, to make the supply water sufficiently cold to cool the flue gases. At present, heat exchange systems in soda recovery boilers do not take into account the efficiency in view of the production of electricity. The throttling of steam and the introduction of heat in the supply water at a cold temperature is not advantageous for the, yield of electricity from the steam process.

BRIEF SUMMARY OF THE INVENTION

It is an aim of the invention to present a method in a soda recovery boiler to improve the efficiency of the production of electricity. It is another aim of the invention to present an improved soda recovery boiler for the above-mentioned purpose.

In the method according to the invention, the final cooling of the flue gases is performed by a circulation water cooler, separately from the supply water system. Consequently, the flue gases are not cooled entirely with supply water. The circulation water cooler is used to introduce the heat of the flue gases to the combustion air instead of the supply water. Pre-heating of the supply water is carried out with flue gases before said circulation water cooler, seen in their flowing direction; that is, the flue gases are cooled only in part with supply water, at the stage where they are initially at a higher temperature.

The higher the average temperature at which the heat is introduced from the flue gases of the soda recovery boiler to the supply water, the better is the yield of electricity. Consequently, it is advantageous to cool the flue gases with supply water until their last cooling stage which is accomplished with the circulation water cooler. The supply water used for cooling the flue gases is preferably preheated with high-pressure steam originating in the steam production of the same boiler, for example, with bleed steam and/or back-pressure steam of a steam turbine. The heat recovered by the circulation water cooler in the last cooling stage of the flue gases can be used to heat the combustion air to a high temperature, and it can be heated further with high-pressure steam.

In the economizer of the soda recovery boiler according to the invention, there is, in the last stage, a circulation water economizer connected to the circulation water cooler of the flue gases, where the water is circulated through a heat exchanger, that is in a heat transfer connection with a combustion air supply channel, and in the supply water economizer stage preceding said circulation water economizer, there is a heat transfer arrangement for the transfer of heat from the flue gases to the supply water.

BRIEF DESCRIPTION OF THE DRAWINGS

In the following, the invention will be described in more detail with reference to the appended drawings, in which.

DETAILED DESCRIPTION OF THE INVENTION

Figure 1:
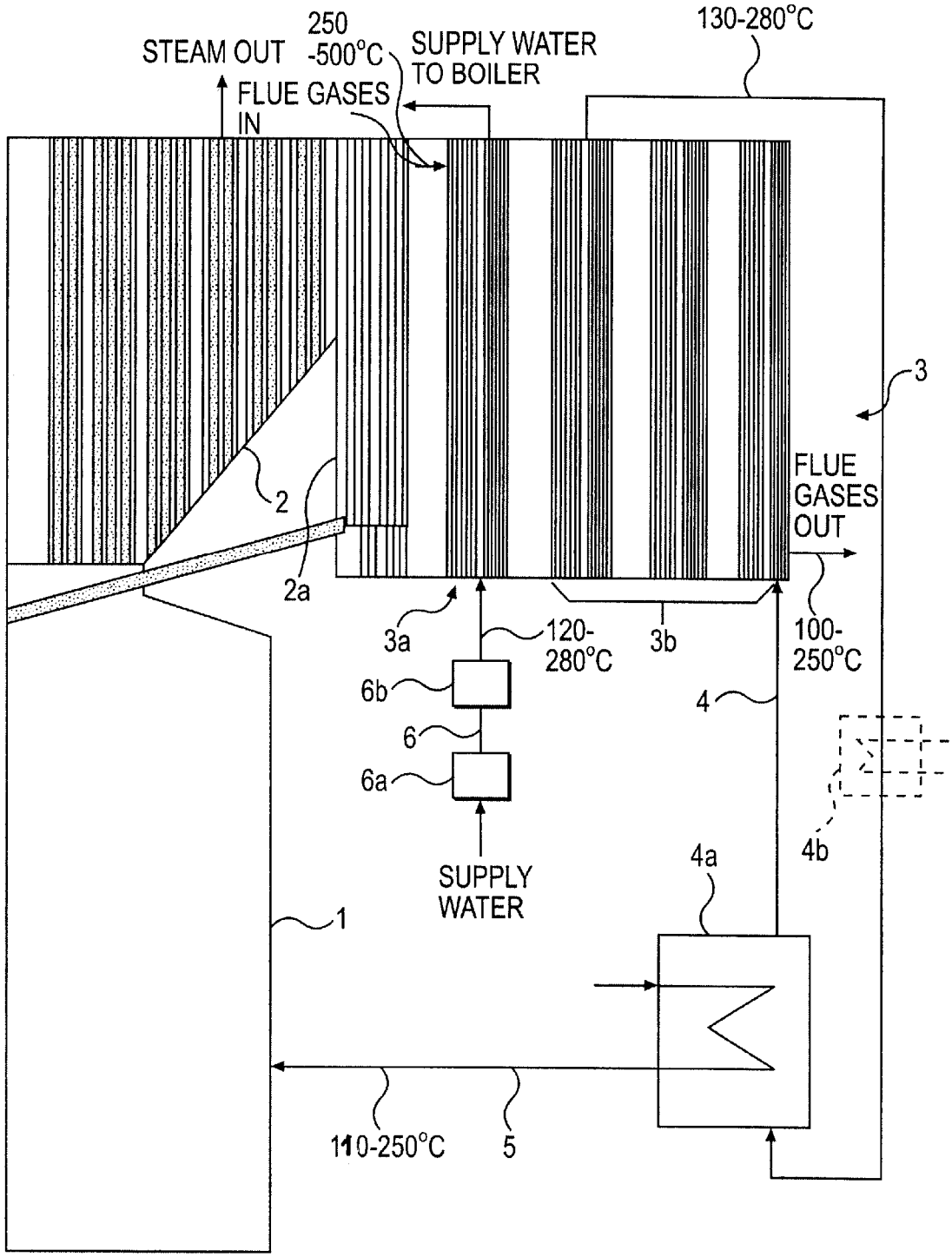
FIG. 1 illustrates schematically a method according to the invention for the transfer of heat from flue gases to combustion air and supply water.

FIG. 1 shows a soda recovery boiler in a schematic view. The soda recovery boiler comprises a furnace 1, in which the production of thermal energy and the recovery of chemicals from spent liquor of chemical pulp production takes place in a known way, above the furnace a superheater 2 for superheating steam, a boiler bank 2*a*, which is an array of boiler tubes, and after the boiler bank a so-called economizer 3, in whose successive stages the flue gases exiting the furnace are cooled by means of water flowing in a construction of vertical tubes and being heated.

The economizer 3 is located in the upper part of the boiler next to the superheater and the boiler bank and comprises successive parts (stages), in which the average temperature of the flue gases is reduced by cooling. After the last stage of the economizer the flue gases enter the flue channel. The last stage of the economizer, i.e. the last economizer packets are cooled by a circulation water cooler 4 shown in FIG. 1. The last three vertical tube type parts (vertical tube packets) of the economizer thus make up the last cooling stage 3*b*, in which the heat transfer takes place by a counter-current principle to the water flowing inside the tubes. The circulation water cooler 4 for flow gases comprises a circulation water economizer 3*b* and a heat exchanger 4*a*, through which is passed the circulation water which cooled the flue gases and was simultaneously heated in the economizer. Through the heat exchanger 4*a* is introduced a combustion air channel 5 which supplies combustion air to the furnace 1 and in which the combustion air is heated.

By the above-described solution, the heat recovered from the flue gases in the economizer at a relatively low temperature is transferred to the combustion air.

Before the above-described final stage in the flowing direction of the flue gases, the economizer 3 includes heating of the supply water (stage 3*a*). A supply water line 6 to the boiler passes through the vertical tube packets of the economizer. The supply water to be introduced in the boiler along the supply water line 6 is heated in the vertical tube type construction of the economizer 3; that is, heat is transferred from the flue gases to the supply water at a higher temperature than to the circulation water which heats the combustion air. Furthermore, the supply water is already preheated in the supply water tank to a temperature corresponding to the steam back-pressure of the pulp mill, and the heating before the introduction of the supply water in the part of the economizer is performed with bleed steam and/or back-pressure steam of the steam turbine that is arranged to produce electricity by the steam produced by the boiler. Heat exchangers for implementing this, placed before the economizer in the supply water line 6 after the supply water tank, are indicated with reference numerals 6*a* and 6*b*.

Consequently, when studying at the flow of flue gases in the economizer 3, it can be stated that the flue gases are first cooled at a higher temperature with supply water (stage 3*a*), which has been preheated by steam from the steam production of the boiler, and the flue gases are then cooled with circulation water which will transfer heat to combustion air (stage 3*b*). The first section of the economizer can thus be called a supply water economizer, and the second section of the economizer a circulation water economizer. In both cases, the cooling takes place by the counter-current principle in the parts of vertical tube construction in the economizer. FIG. 1 shows the circulation water cooler 4 for flue gases, whose economizer part comprises three circulation water economizer packets (stage 3*b*) and whose supply water part comprises one packet (stage 3*a*). The division can also be made in another way; for example, the circulation water economizer comprises only one packet of vertical tubes and the supply water economizer comprises two packets of vertical tubes.

FIG. 1 shows the inlet temperature of flue gases entering the economizer 3 after the boiler bank 2*a*, the outlet temperature of flue gases exiting the economizer 3, the inlet temperature of supply water entering the supply water economizer, the outlet temperature of circulation water of the circulation water cooler 4 exiting the circulation water economizer, and the inlet temperature of combustion air after the heat exchanger. The temperatures are indicated as temperature ranges.

If the heat absorption capacity of the combustion air is not sufficient, or if there are other reasons to use the heat of the circulation water for other purposes than for heating air, it is possible to couple an auxiliary heat exchanger at any location in the circulation water circuit, either in parallel or in series with the heat exchanger 4*a* heating the combustion air. The auxiliary heat exchanger serves to cool the circulation water further, for example by water. At the same time, hot water is produced. In FIG. 1, such an auxiliary heat exchanger 4*b* is indicated with a broken line.

Figure 2:
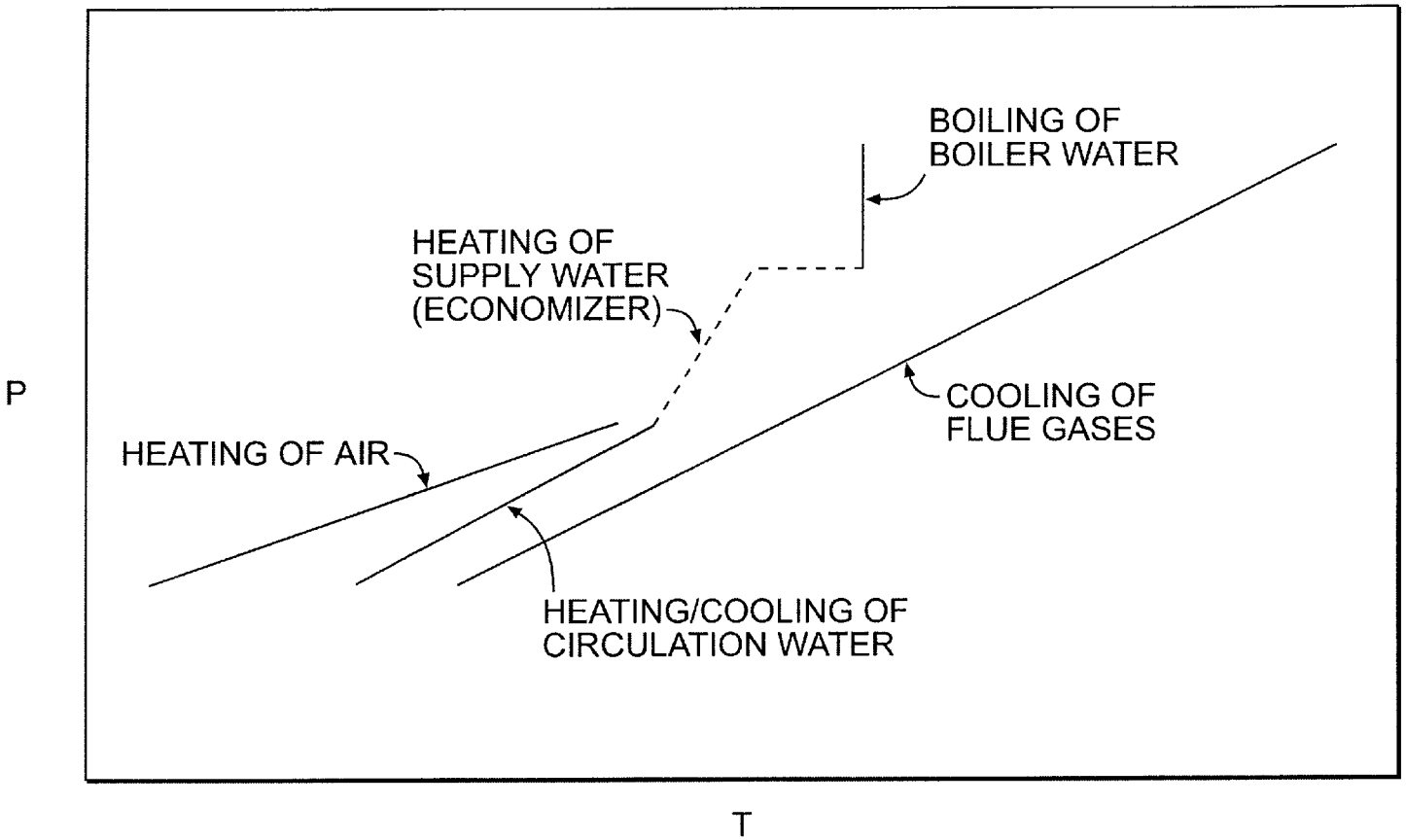
FIG. 2 illustrates the thermal powers of flue gas, water and air as a function of temperature in the method of FIG. 1.

FIG. 2 shows the thermal powers of the material flows (flue gas, water and combustion air) as a function of temperature in the system of FIG. 1. The curve illustrating the heating of water consists of two material flows: the heating of circulation water in the last stage of the cooling of the flue gases, and the heating of supply water in the stage preceding the cooling of flue gases and its later boiling in the boiler.

Figure 3:
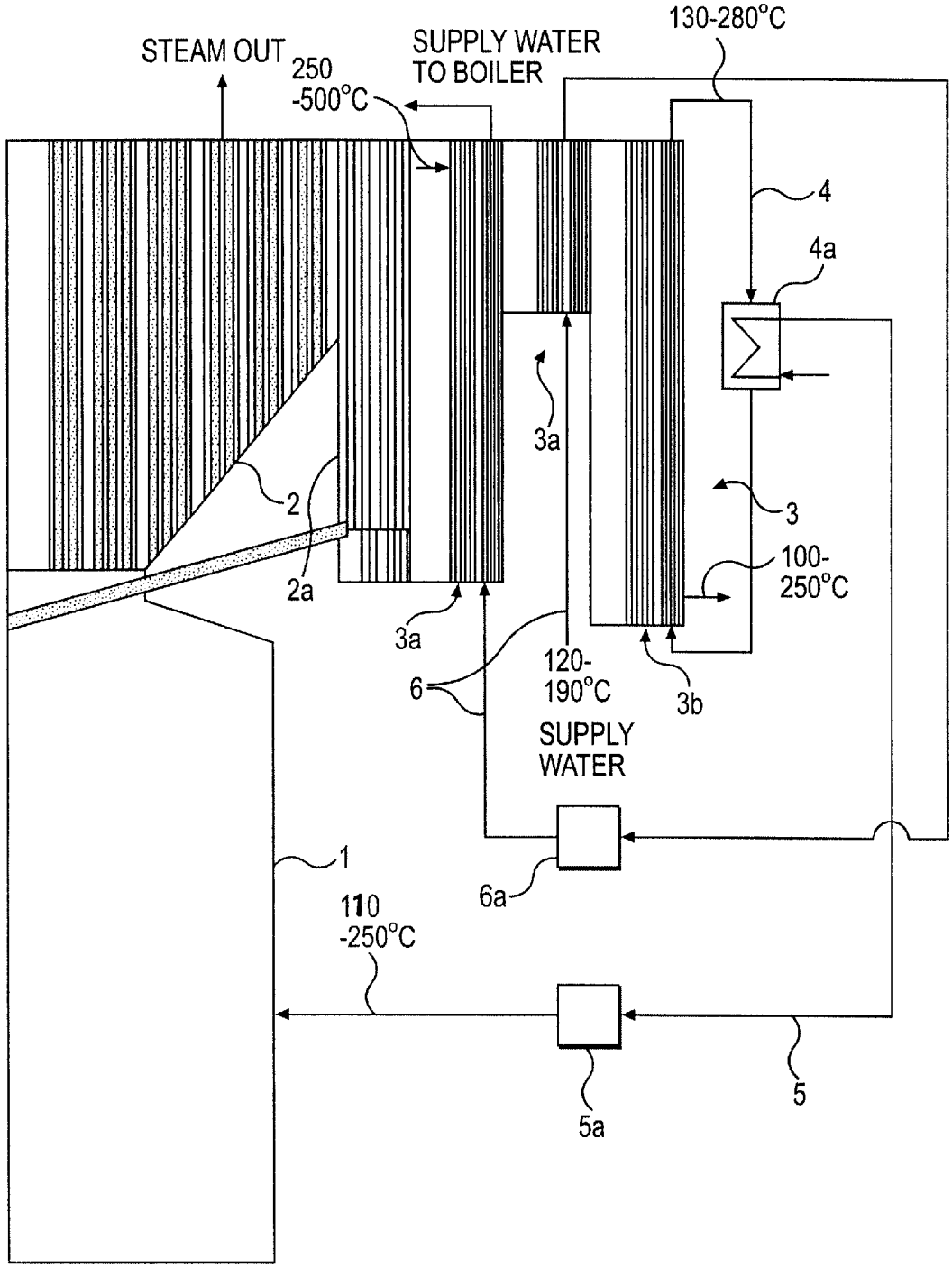
FIG. 3 shows another method according to the invention.

FIG. 3 shows another alternative. Here, the same elements are indicated with the same reference numerals as in FIG. 1. Combustion air is heated by a circulation water cooler passing through the last cooling stage 3*b* of flue gases, as above (the part of vertical tube construction forming the last stage 3*b*). The preceding part of the economizer 3 of the vertical tube construction is used for heating preheated supply water whose temperature is thereafter raised by bleed steam and/or back-pressure steam of the steam turbine (heat exchanger 6*a* in the supply water line 6), and after this, it is led to the part of the vertical tube construction preceding said part in the economizer 3. These parts constitute the first stage 3*a* of the economizer. The flue gases are now cooled in three stages by the circulation water cooler and supply water: in the first stage, seen in their flow direction, with supply water whose temperature has been raised by steam from the steam production of the same boiler, in the second stage with the same supply water which is at a lower temperature, and in the final stage by the circulation water cooler 4.

Thus, whereas in FIG. 1 the supply water is preheated by steam in one or several heat exchangers before entering the economizer, in FIG. 3 the supply water is heated by steam in a separate intermediate stage between two stages of the economizer while being out of the economizer.

FIG. 3 also shows how combustion air can also be heated after the heat exchanger 4*a* with bleed steam and/or back-pressure steam of the steam turbine (heat exchanger 5*a* in the combustion air channel 5). FIG. 3 shows the temperatures of the material flows by the same principle as in FIG. 1.

Figure 4:
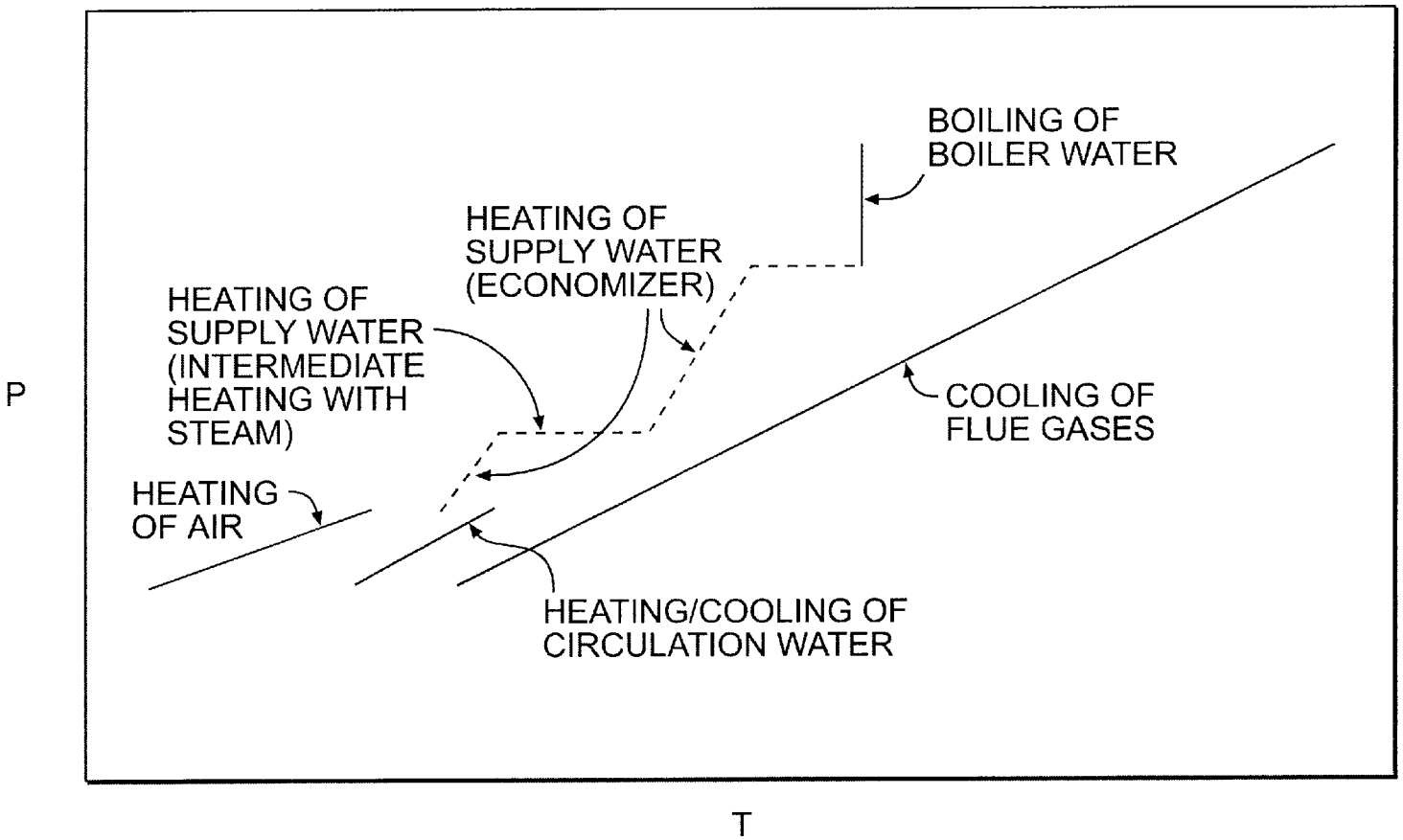
FIG. 4 illustrates the thermal powers of flue gas, water and air as a function of temperature in the method of FIG. 3.

FIG. 4 shows the system of FIG. 3 by the same principle as in FIG. 2. What is in common with the system of FIG. 1 is that also here the flue gases are cooled in the last stage by circulation water, from which the heat is transferred to combustion air. The difference is that the supply water is led by the countercurrent principle through two successive cooling stages of flue gases, by raising its temperature with high-pressure steam between the stages.

It is understood that heat transfer from flue gases to the water in the economizer and from steam to water in heat exchangers takes place between separated streams of gases and water and steam and water, respectively, through walls separating these streams from each other.

Figure 5:
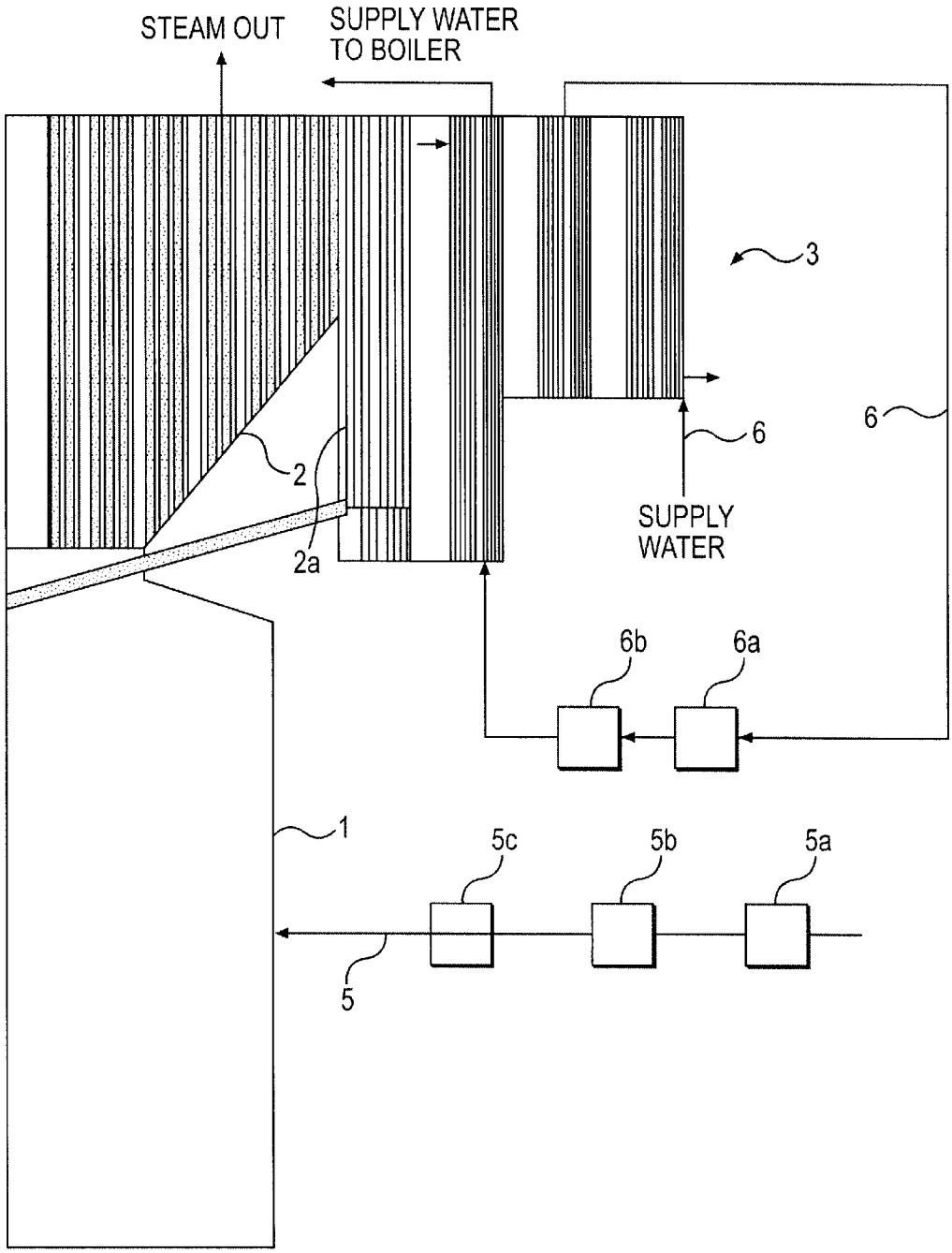
FIG. 5 PRIOR ART
FIG. 5 illustrates, for comparison, a method of prior art.
Figure 6:
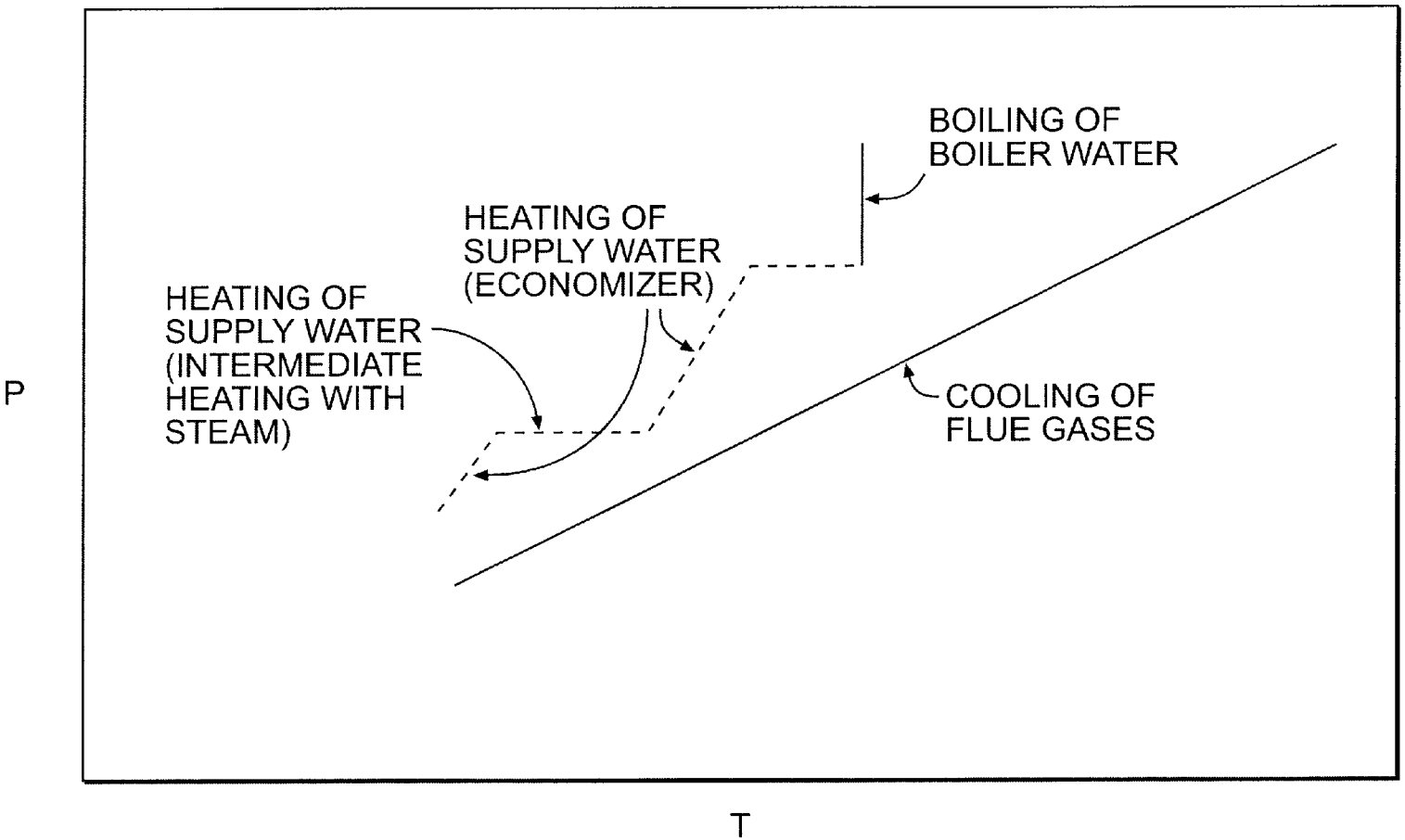
FIG. 6 PRIOR ART
FIG. 6 illustrates the thermal powers of flue gas, water and air as a function of temperature in the method of FIG. 5.

For comparison, FIGS. 5 and 6 show the method known from Finnish patent FI-101163 and the corresponding European patent EP-724683, in which the flue gases are cooled with supply water in all the stages in the economizer 3 by raising the temperature of the supply water between the stages by means of back-pressure steam and/or bleed steam of the steam turbine, and the combustion air is pre-heated by steam only (heat exchangers 5*a*, 5*b* and 5*c*).

The invention makes it possible to improve the production of electricity (electricity-to-heat production ratio) in the soda recovery boiler. In the soda recovery boiler, it is possible to build a sufficiently large economizer, to which the supply water can be introduced in a preheated state.

The invention can be applied both in new soda recovery boilers and in old soda recovery boilers after modifications. The size of the economizer can thereby be increased, and heating of the supply water with bleed steam can be coupled between the parts of the economizer. The last part of the economizer can be coupled to operate by circulation water, and this circulation water can be coupled to the preheating of combustion air.

The invention is not limited to the above-presented embodying examples but it can be modified within the scope of the claims.

Above, the invention has been described in connection with soda recovery boilers, to which also the claims relate. The arrangement according to the invention can also be used in other boilers involving the problem of fouling properties of the flue gases.

We claim:

1. A method in a soda recovery boiler, in which supply water is introduced to the boiler through a supply water system for steam production of the boiler and flue gases are led through an economizer having successive stages to recover heat from the flue gases, the flue gases being cooled in the last stage of the economizer by a circulation water cooler for flue gases, separately from the supply water system of the boiler, wherein the circulation water cooler for flue gases is used to preheat combustion air.

2. The method according to claim 1, wherein the flue gases are cooled with supply water in a stage preceding the last stage of the economizer.

3. The method according to claim 2, wherein the temperature of the supply water is raised in an intermediate stage between two successive stages of the economizer as it is passed through the economizer, or it is raised before it is introduced in the economizer.

4. The method according to claim 3, wherein the temperature of the supply water is raised with steam originating in the steam production of the boiler.

5. A soda recovery boiler comprising a supply water system, a furnace, a flow passage for leading flue gases out of the furnace, and an economizer having successive stages and arranged in the flow passage of flue gases to recover heat from flue gases exiting the furnace, the last stage of the economizer comprising a circulation water cooler for flue gases to cool flue gases, said circulation water cooler being separate from the supply water system of the boiler and being coupled via a heat exchanger to a heat transfer connection with a combustion air channel.

6. The soda recovery boiler according to claim 6, wherein the supply water system comprises a supply water line which is led to an economizer stage preceding the last stage of the economizer, to heat supply water.

7. The soda recovery boiler according to claim 6, wherein the supply water system comprises between or before successive parts of the economizer one or more heat exchangers coupled to a steam source.

8. The soda recovery boiler according to claim 6, wherein a circulation water system of the circulation water cooler for flue gases comprises an auxiliary heat exchanger for heating water.

9. The soda recovery boiler according to claim 6, wherein the supply water system comprises a supply water line which is led to an economizer stage preceding the last stage of the economizer, to heat supply water.

10. The soda recovery boiler according to claim 9, wherein the supply water line comprises between or before successive parts of the economizer one or more heat exchangers coupled to a steam source.

11. A method in a soda recovery boiler, in which supply water is introduced to the boiler through a supply water system for steam production of the boiler and flue gases are led through an economizer having successive stages to recover heat from the flue gases, the flue gases being cooled in the last stage of the economizer by a circulation water cooler for flue gases, separately from the supply water system of the boiler, wherein the flue gases are cooled with supply water in a stage preceding the last stage of the economizer, and wherein the temperature of the supply water is raised in an intermediate stage between two successive stages of the economizer as it is passed through the economizer, or it is raised before it is introduced in the economizer.

12. The method according to claim 11, wherein the temperature of the supply water is raised with steam originating in the steam production of the boiler.

13. The method according to claim 11, wherein the circulation water cooler for flue gases is used to preheat combustion air.

* * * * *